United States Patent [19]

Hunt

[11] Patent Number: 4,473,985

[45] Date of Patent: Oct. 2, 1984

[54] BUILDING BLOCK

[76] Inventor: Terence Hunt, "Reform Cottage", Salem, Llandeilo, Dyfed, Wales, SA19 7ND.

[21] Appl. No.: 407,584

[22] Filed: Aug. 12, 1982

[30] Foreign Application Priority Data

Apr. 30, 1982 [GB] United Kingdom ..... 8212573

[51] Int. Cl.[3] ..... E04C 1/10

[52] U.S. Cl. ..... 52/593; 52/503; 52/570

[58] Field of Search ..... 52/593, 503, 570, 571, 52/605, 594

[56] References Cited

U.S. PATENT DOCUMENTS 2,693,694 11/1954 Lapidus ..... 52/503

FOREIGN PATENT DOCUMENTS 905471 12/1945 France .
1002508 3/1952 France .
56908 10/1952 France .
1029039 5/1953 France .
1312989 11/1962 France .
WO79/00198 4/1979 PCT Int'l Appl. .
350453 1/1961 Switzerland .
577052 5/1946 United Kingdom .
591067 8/1947 United Kingdom .
654057 6/1951 United Kingdom .
788652 1/1958 United Kingdom .
1388117 3/1975 United Kingdom ..... 52/593

*Primary Examiner*—J. Karl Bell
*Attorney, Agent, or Firm*—Brown & Martin

[57] ABSTRACT

A building block has an inner and an outer wall defining a cavity therebetween, the two walls being interconnected by two or more webs positioned intermediate the top and bottom of the block to provide upper and lower horizontal channels. The walls at the top each have a longitudinal projection extending along an inner portion which in a building locates the blocks by being positioned in the lower horizontal channel. The block has two end portions which are either both a female recess or a male protrusion so that the block can be reversed if necessary. A building is formed by using a plurality of double-male and double-female blocks and interlocking them together, load being transmitted to below through the outer portions of the inner and outer walls.

5 Claims, 25 Drawing Figures

BUILDING BLOCK

TECHNICAL FIELD

This invention relates to an improved building block and in particular to an interlocking building block.

BACKGROUND ART

Interlocking blocks are known and there have been many proposals in the past, the closest prior art of which I am aware being the publication of International Patent application No. PCT/GB80/00069 in which I am named as an inventor. Further prior art of which I am aware are the disclosures in the following Patent specifications.

United Kingdom Pat. No. 577052
United Kingdom Pat. No. 591067
United Kingdom Pat. No. 654057
United Kingdom Pat. No. 788652
Swiss Pat. No. 350453
French Pat. No. 1135128
French Pat. No. 56908 (Addition to No. 1002508)
French Pat. No. 1002508
French Pat. No. 1209309
French Pat. No. 1312989
French Pat. No. 905471
International Patent application Publication No. WO79/00198.

The earlier specification No. PCT/GB80/00069 discloses a building block comprising an inner wall and a spaced, parallel outer wall, at least one web connection between the inner and outer walls, an offset face on said outer wall, said face being offset vertically to provide a projecting extension along the greater part of a horizontal edge of the outer wall, and a rebate along the greater part of the opposed horizontal edge of the outer wall whereby one block may interengage with adjacent blocks above and below, the offset face being so arranged, by the provision of the projecting extension being smaller in depth than the corresponding rebate and the projecting extension and the rebate each having a generally vertically extending inner wall, one of which has a contoured surface portion facilitating interengagement of a projecting extension and a cooperating rebate, that the offset face merely locates the block where the load is transmitted through the inner and outer walls.

Whilst that form of block is technically satisfactory I have found in practice that it is susceptible to damage and requires to be made to extremely close tolerances whereas the block of the present invention transmits the load through the outer sections of the block so that they are thicker and resist damage. Moreover, with the standard block, if damage does occur to one face of the block the block can be turned through 180° to present the other face to the outside. Similar objections relate to the other prior art mentioned above, for example: United Kingdom Patent specification No. 577052 illustrates a moulded block formed of three vertical parallel and spaced layers, the intermediate layer projecting beyond the outer layers, at one end and at the top or bottom, and being inset at the other end and at the top or bottom so that adjacent blocks will interlock. However, in that arrangement the block is complicated to mould and the location is provided by the same portions of the block as those which transmit the load.

United Kingdom Patent specifications Nos. 591067 and 788652 both illustrate similar blocks to the invention disclosed in our previous specification having an offset locating face with load transmit through the inner and outer walls. However, in both disclosures the projecting portions are intended to compliment the rebates. Whilst such an arrangement is satisfactory where the tolerances can be controlled exactly in practice this cannot be done. This has the result that in some blocks where tolerance variations exist the load will be transmitted only through the locating face and not through the block as a whole, thus producing a weakened structure. Also including such a variation will cause the block to be positioned incorrectly, an error which will become exaggerated as a structure is built with such blocks and cannot readily be corrected.

United Kingdom Patent specification No. 654057 discloses another block of this type having an offset locating face providing projecting portions and corresponding rebates which are arranged to leave a narrow gap between adjacent edges of the blocks. These gaps increase the labour requirement since they have to be filled with mortar or cement to ensure a firm structure. However, whilst the gaps will aid in seating the blocks one on another, the offset faces are still susceptible to damage and tolerance variations cannot be accommodated.

Swiss Patent specification No. 350453 discloses building bricks which makes it possible to interlock horizontally and vertically so that a strong structure may be produced. However, the arrangement has opposed male and female end connectable portions so that identically constructed building elements may interlock with one another.

French Patent specification No. 1135128 discloses a similar type of building block which is characterized by a special shape consisting of a cavity with a recess and a boss on two opposing faces. The recess and the boss are complimentary so that two identical bricks may be interlocked.

French Patent Of Addition No. 56908 and its parent Pat. No. 1002508 discloses a block which interlocks from above and below and at each end. However, the blocks are male at one end and female at the other so that they cannot be turned around. Moreover, the blocks proposed are of a complicated configuration making it difficult to mould, and susceptible to tolerance variations.

French Patent specification No. 1029039 is similar to our earlier specification in disclosing male and female interlocking. However, this prevents the problems discussed above.

French Patent specification No. 1312989 is yet another block in which interengagement is from above and below and at each end but with opposed male and female end portions so that the blocks can only be used one way around.

International Patent specification WO 79/00198 discloses a block in which the load is transmitted through the outside of the block. However, the block discloses male and female end portions which will not permit reversal of the block in the present of tolerance variations.

SUMMARY OF THE INVENTION

According to the present invention there is provided a block having end portions which in use may cooperate with the end portions of adjacent blocks so that the blocks may interlock with one another, said end portions of each block either both being female end portions or both being male end portions. The end portions may be aligned as in a standard rectangular block or may be offset as in a corner block.

More particularly, a building block comprises an inner wall, and a spaced, parallel outer wall defining a cavity therebetween, at least one web connection between the inner and outer walls, longitudinal projections extending one from the upper edge of each of the inner and the outer walls, and two end portions both being either a female recess or a male protrusion to form a double-male or double-female block, the arrangement being such that, in a structure comprised of a plurality of double-male and double-female blocks, blocks interlock with one another horizontally and vertically, load is transmitted to below through the outer portions of the inner and outer walls, and the longitudinal projections are disposed in the respective cavities of adjacent blocks to locate one block upon another.

Preferably the, or each, web is positioned so as to provide longitudinal upper and lower channels. A block may be provided with a central side opening for service fixtures or connection of partition walling.

The invention will now be described by way of example with reference to the accompanying drawings in which.

Figure 2C:
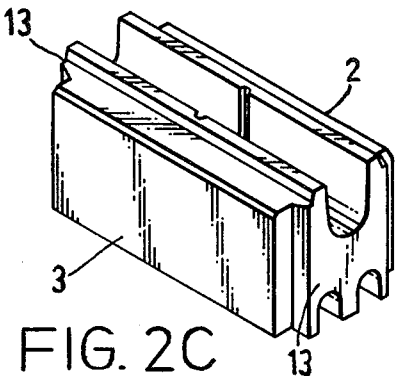
Figure 2B:
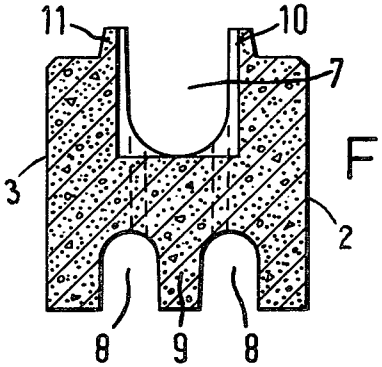
Figure 2:
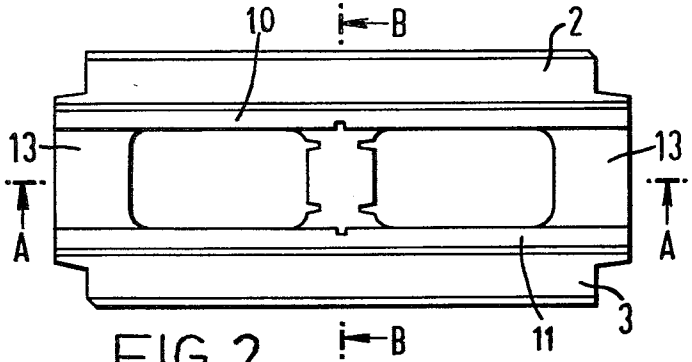
Figure 2A:
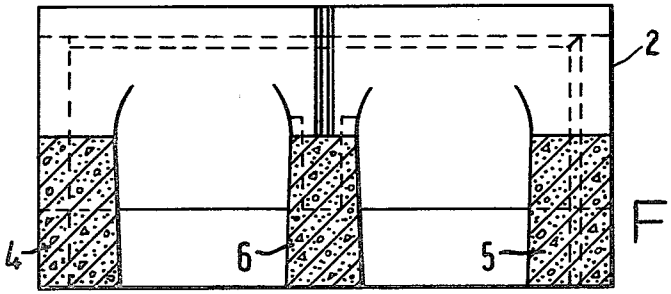
Figure 3C:
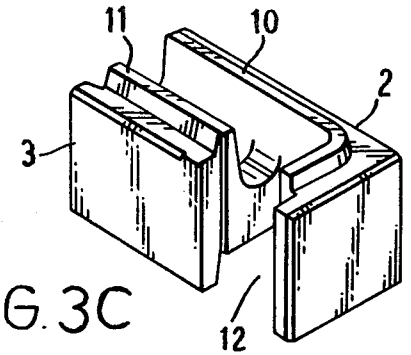
Figure 3B:
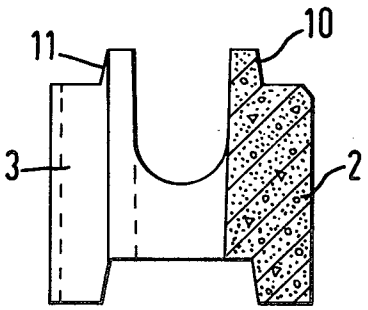
Figure 3:
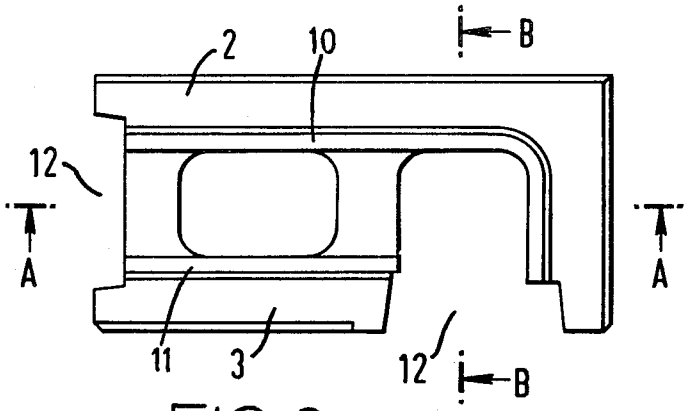
Figure 3A:
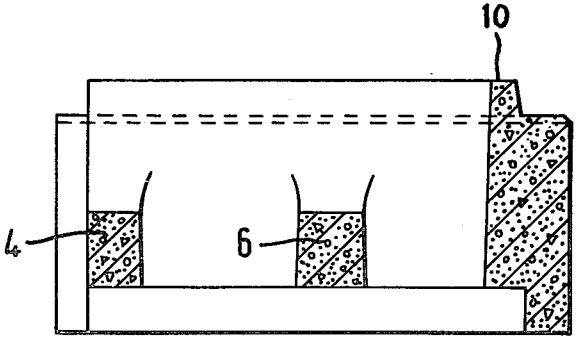
Figure 4C:
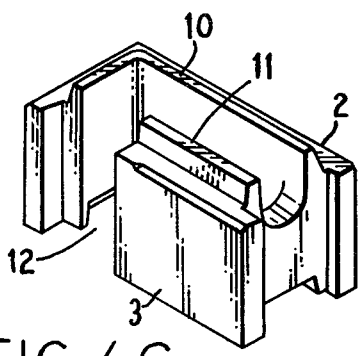
Figure 4B:
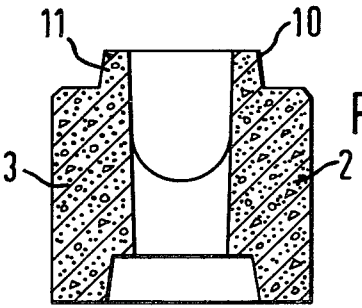
Figure 4:
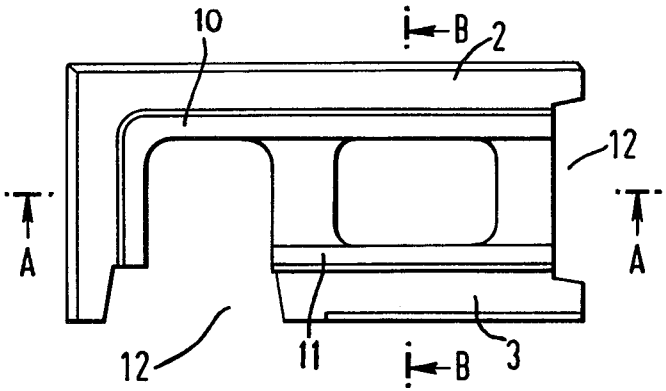
Figure 4A:
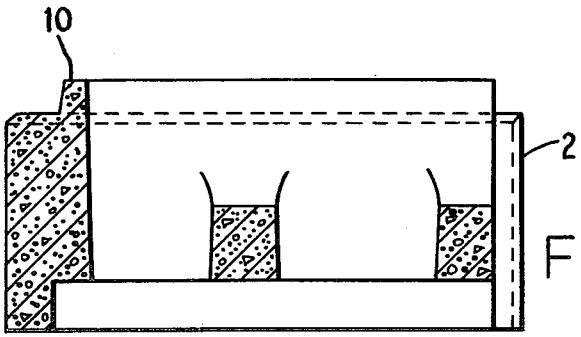
Figure 5C:
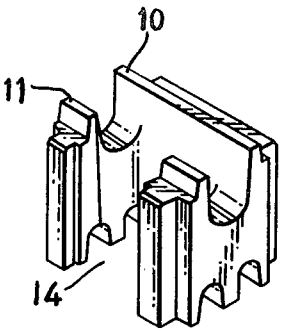
Figure 5B:
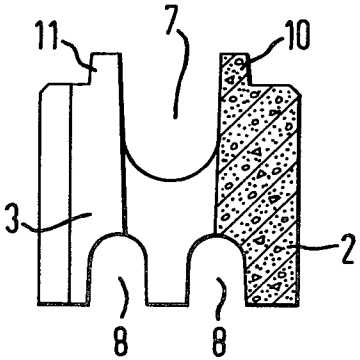
Figure 5:
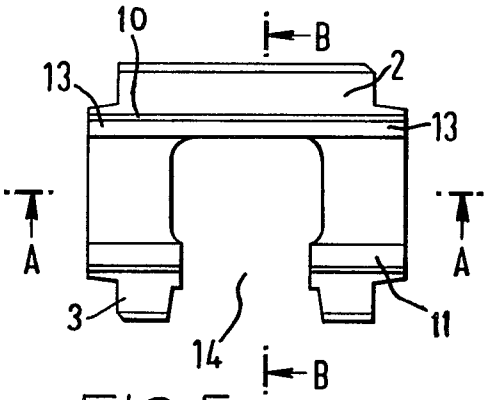
Figure 5A:
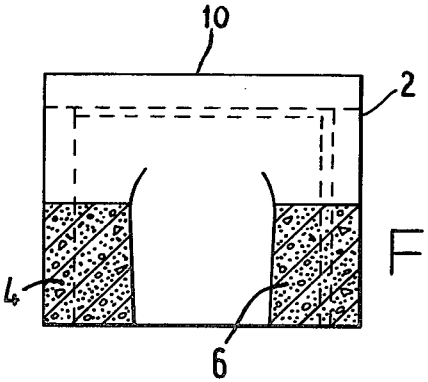
Figure 6C:
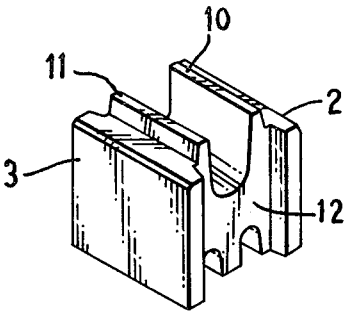
Figure 6B:
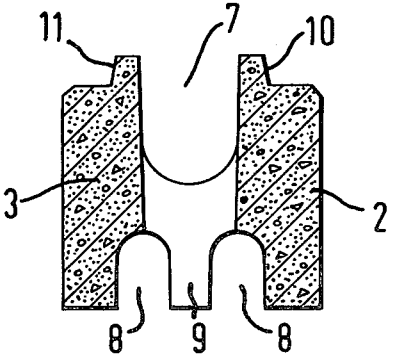
Figure 6:
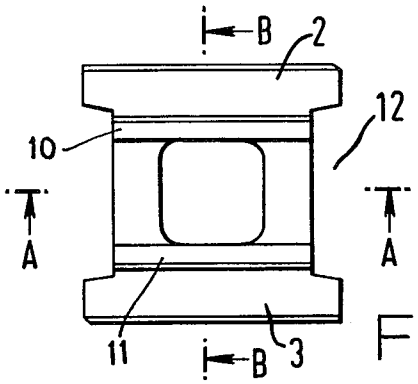
Figure 6A:
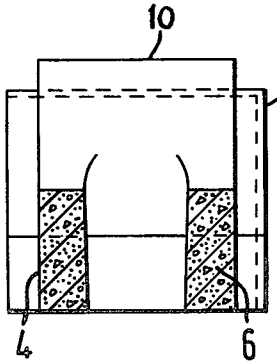

FIGS. 2-2C similarly illustrate a double male type block;

FIGS. 3-3C similarly illustrate a double female right-hand corner block;

FIGS. 4-4C similarly illustrate a double female left-hand corner block;

FIGS. 5-5C similarly illustrate a double male half block with a female side portion for an interconnecting internal wall;

FIGS. 6-6C similarly illustrate a double female half block, and

Figure 7:
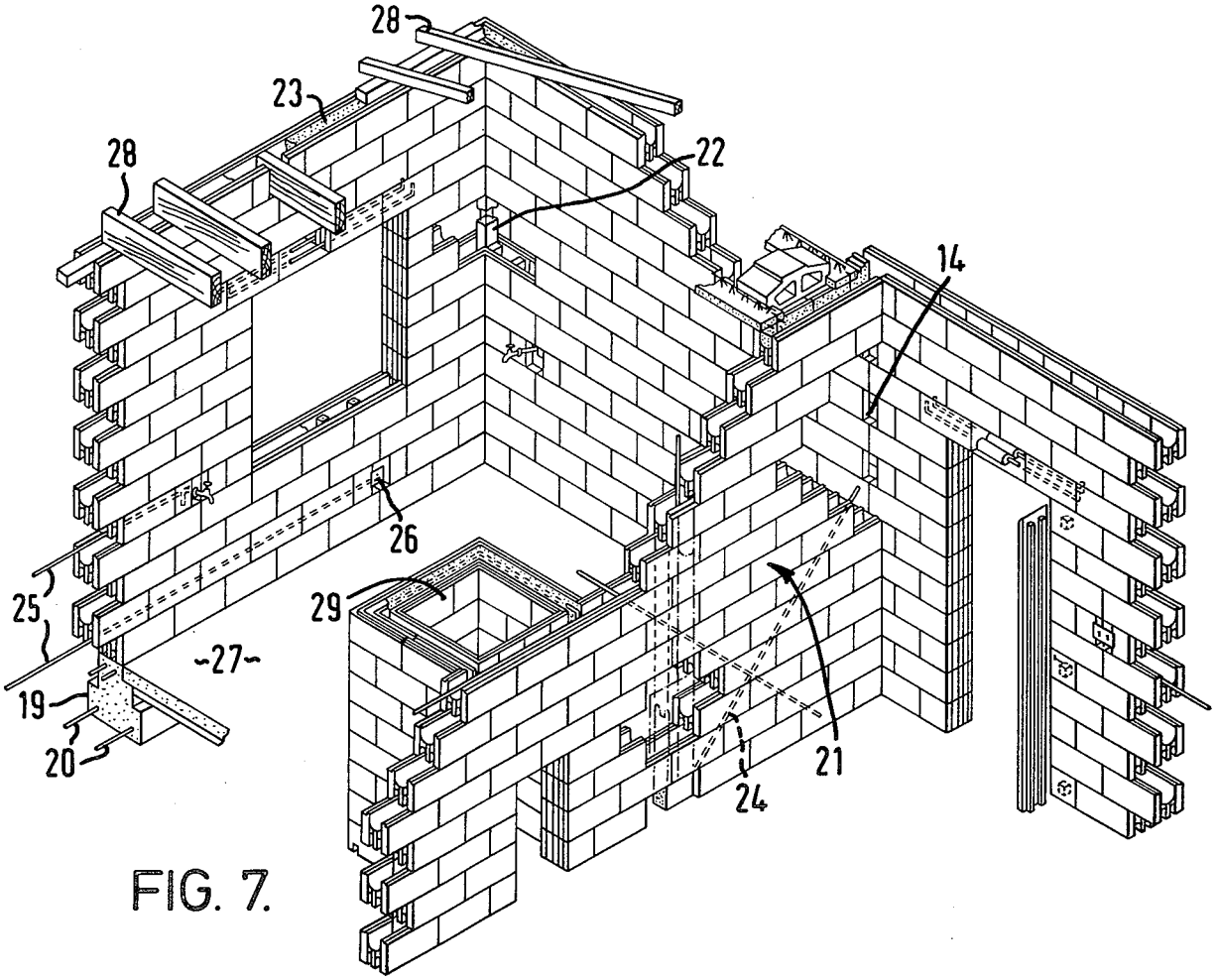

FIG. 7 is a perspective view of a building structure showing the various blocks in use.

Figure 1C:
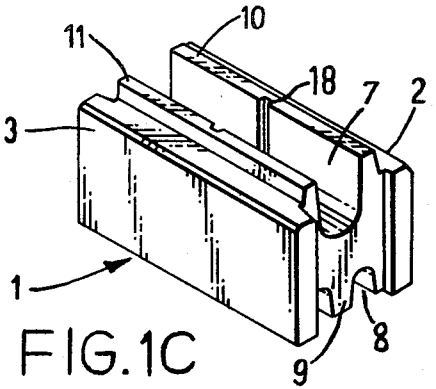
FIG. 1C is a perspective view of the double female type block.
Figure 1B:
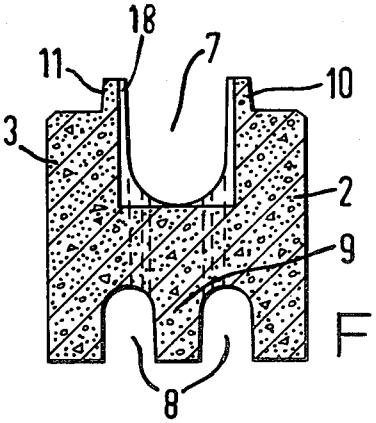
FIG. 1B is a sectional view taken on line B—B of FIG. 1.
Figure 1:
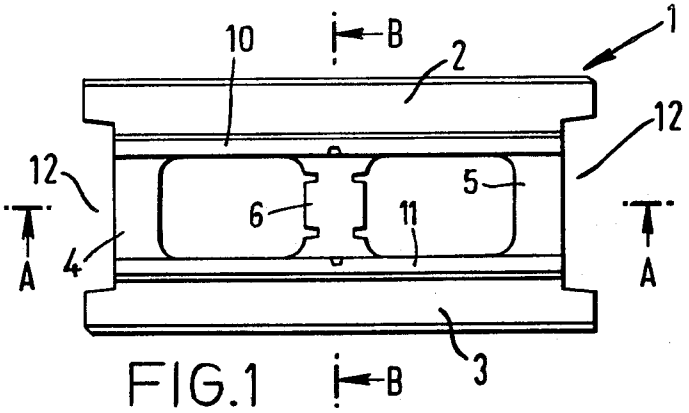
FIG. 1 is a top plan view of a double female type block.
Figure 1A:
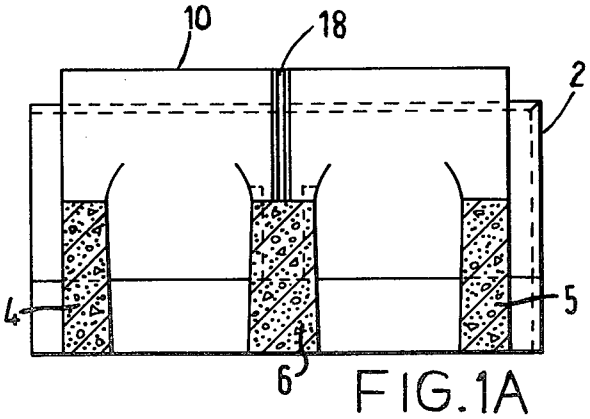
FIG. 1A is a sectional view taken on line A—A of FIG. 1.

In FIGS. 1 and 2 of the drawings, a building block 1 has inner and outer spaced and parallel walls 2 and 3. The walls 2 and 3 are spaced by means of interconnecting end webs 4 and 5 and a central web 6 which is removable so that webs 4 and 5 together with the walls 2 and 3 define a cavity which in a building will extend vertically.

The webs 4, 5 and 6 are displaced both from the top and from the bottom of the block 1 so as to define an upper channel 7 and a lower channel 8 which, in a building, will extend horizontally. The lower channel 8 may, if requires, be supported as shown in the drawings by depending portion 9 of the webs 4, 5 and 6.

The upper edges of the walls 2 and 3 are provided with respective longitudinal projections 10 and 11 which are in vertical alignment with the channel 8 but which have a height less than the depth of the channel. Accordingly, when one block is positioned upon another the side walls 2 and 3 of one block rest firmly upon the side walls of the block below so as to transmit load and the longitudinal projections 10 and 11 of the underneath block are disposed within the respective channel 8 of the block above so as to provide location for the blocks and to act as a water barrier.

From FIGS. 1 and 2 it will be seen that the ends of the blocks are either formed with a tapered female recess 12 at each end (double-female block, FIG. 1) or a protruding male portion 13 at each end (double-male block, FIG. 2), In the double-female block the projections 10 and 11 only extend between opposed recesses 12 whereas, in the double-male block the projections 10 and 11 are continued with the protruding male portions 13 as shown. In this way a double-male block may cooperate with a juxtaposed double-female block so that the blocks are interlocked horizontally as well as vertically.

By providing double-male or double-female blocks rather than the identical cooperable blocks disclosed in the prior art, a builder is able to put the block either way around. This enables chipped blocks to be placed the other way around, or if there is a tolerance the block can be self-aligned by turning alternate blocks through 180° as they are laid. Otherwise the tolerance variations, which may only have been, say, 2 mm., will become exaggerated by multiples of 2 mm. for each block course. The blocks also have central internal grooves 18 for use in vertical reinforcement as explained with reference to FIG. 7.

FIGS. 3 and 4 illustrate right-hand and left-hand corner blocks and for clarity equivalent parts have been given the same reference numerals as in FIGS. 1 and 2. Although the blocks are both double-female, they could be double-male blocks if desired though this would make the blocks very difficult to mould. In accordance with the invention the load bearing is effected by the outer portions of the walls 2 and 3 so that the projections 10 and 11 merely serve as locators and for protection against water penetration. Being corner blocks, the female end recesses 12 are offset longitudinally of the block so that recess 12 at the end forming the corner opens laterally. Moreover, when compared with say the corner blocks in FIG. 17 of the aforementioned earlier International application, the recess 12 has been tapered right back to the cavity to facilitate production.

FIG. 5 illustrates a double-male half block having a centrally disposed side female opening 14 as shown for service fixtures and partition walling. The single block, with a central side opening, rather than three blocks previously required, for example with a half-block, allows a wall to return and interlock adjacent a corner without cutting as would otherwise be required. Alternatively, a whole block with a central side opening 14 may be provided as shown in FIG. 7. In FIG. 6 a similar half-block but double-female without a side opening is illustrated.

All the block of the present invention as can be seen from the drawings have:

(a) double-male or double-female end portions;
(b) load bearing through the outer parts of the side walls;
(c) tapered longitudinal projections for location purposes;
(d) upper and lower longitudinal channels;
(e) longitudinal load bearing surfaces the lateral depth of the longitudinal projections. This provides improved stability and deters chipping. For example, in the preferred embodiment each wall 2 and 3 has a total lower lateral depth of load bearing surface of 40 mm. a total upper lateral depth of 60 mm. of which 21.5 mm constitutes the lateral depth of the longitudinal projection;

(f) upper longitudinal edges of the walls 2 and 3 which are chamfered; and (g) a cavity.

The moulding process may be conventional and consist of a static mould open to the top and the bottom for shaping the side walls and webs of the blocks, a block supporting pallet reciprocal relative to the bottom of the mould, a laterally reciprocal core member for shaping the lower longitudinal channel movable in synchronism with the pallet, and a stripper shoe to shape the top configuration of the side walls. The method steps are as follows:

(i) the pallet and core member are moved in synchronism to the static mould so that the open bottom of the mould is closed by the pallet and the core member defines the lower, longitudinal channel;

(ii) the mould is filled with suitable material from which the block is to be made and vibrated to fill the web portions beneath the mould;

(iii) the shape of the top of the walls of the block is applied by the stripper shoe which is then removed;

(iv) the core member is withdrawn and the stripped pallet moved away from the mould with the block material which is allowed to set.

By using a reciprocal core member it is essential to have a centre piece 9 to support the block in the green state. However, this middle support would not be required if the flat pallet and core member were replaced by a former which would itself support the block in the green state.

FIG. 7 illustrates how the blocks of the present invention are used in practice with vertical and horizontal reinforcement, services and partitioning.

Thus, a building may be formed upon a foundation 19 provided with horizontal reinforcement 20. Courses of alternate double-male, double-female blocks are built up as appropriate with the inclusion of service blocks, of the type shown in FIG. 5, for example, used to tie in a partition wall 21. Vertical reinforcement 22 may be provided by a single vertical column defined by inserting appropriate plates (not shown) in central interal grooves 18 on alternative courses. Reinforcement is suitably also provided horizontally 23 at ceiling level and may be laid diagonally 24 for certain stresses encountered in high rise structures.

The provision of upper channels 7 in the blocks permits services, such as water and electricity 25, to be fed along the upper channels 7 with outlets eg: 26 provided by the services blocks of FIG. 5. Window and door frames may be fitted to the blocks as necessary and, to provide the necessary strength to support the load above precast lintels, for positioning over windows and doors and for forming horizontal ring beams, may be made as required using the standard blocks, concrete and longitudinal metal reinforcement being applied to the upper channels 7 as appropriate.

In the building the flooring 27 may be attached to the foundation ring beam 19 as shown and similar ring beams are provided for additional floors. The roofing 28 may be attached to the walls by various means, two of which are illustrated, depending upon the type of roof to be employed. Piers and columns 29 may be produced for vents, ducts or flues using the corner blocks of FIGS. 3 and 4.

The blocks of the present invention provide a simple means of constructing a building which may be assembled employing relatively unskilled labour. The finished building may be rendered or the blocks themselves may be provided with a desired finish.

What is claimed is:

1. A building block comprising an inner wall, an outer wall spaced from and parallel to the inner wall, a cavity defined between the inner and the outer walls, at least one web connection between the inner and the outer walls, two end portions, said end portions both including either a female recess or a male protrusion thereby forming a double-female block or double-male block respectively, said female recess tapering inwardly from a wider mouth and said male protrusion tapering outwardly from a wide inner portion whereby cooperating end portions of adjacent juxtaposed male and female blocks may interlock simply by butting one block against the other, and longitudinal projections extending one from an inner portion of the upper edge of each of the inner and outer walls, the longitudinal projections being aligned with the double recess or double protrusion of the block and having a length defined thereby, and the longitudinal projections each tapering from a wider inner portion to a narrower free edge, the blocks being adapted to be assembled together such that, in a structure comprised of a plurality of cooperating double-male and double-female blocks, adjacent blocks are simply butted up to one another to interlock with one another horizontally and vertically, load is transmitted to below through the outer portions of the inner and outer walls, and the longitudinal projections are disposed in the cavities of adjacent blocks above to locate one block upon the other.

2. A building block according to claim 1 wherein each web is displaced both from the top and from the bottom of the block so as to define an upper channel and a lower channel in the block.

3. A building block according to claim 1 wherein the body is substantially rectangular with said end portions aligned with one another.

4. A building block according to claim 1 wherein the body is substantially rectangular with the end portions being perpendicular to one another to provide a corner block.

5. A building block according to claim 3 wherein a side opening is provided intermediate said end portions for the accommodation of service fixtures or internal partition walling.

* * * * *